United States Patent [19]

Shibuya et al.

[11] Patent Number: 4,546,814

[45] Date of Patent: Oct. 15, 1985

[54] PROCESS AND APPARATUS FOR THE PRODUCTION OF RAPIDLY SOLIDIFIED METALLIC TAPES BY DOUBLE-ROLL SYSTEM

[75] Inventors: Kiyoshi Shibuya; Masao Yukumoto; Takahiro Kan; Yo Ito, all of Chiba, Japan

[73] Assignee: Kawasaki Steel Corporation, Kobe, Japan

[21] Appl. No.: 496,849

[22] Filed: May 23, 1983

[30] Foreign Application Priority Data

May 24, 1982 [JP] Japan ..... 57-87690

[51] Int. Cl.[4] ..... B22D 11/16

[52] U.S. Cl. ..... 164/455; 164/428; 164/480

[58] Field of Search ..... 164/414, 428, 452, 455, 164/480

[56] References Cited

U.S. PATENT DOCUMENTS 2,790,216 4/1957 Hunter ..... 164/480

3,587,708 6/1971 Khimich et al. ..... 164/480

*Primary Examiner*—Nicholas P. Godici

*Assistant Examiner*—Richard K. Seidel

*Attorney, Agent, or Firm*—Balogh, Osann, Kramer, Dvorak, Genova & Traub

[57] ABSTRACT

A process and an apparatus for producing rapidly solidified metallic tapes by a double-roll system are disclosed, wherein molten metal is poured into a kissing region defined between a fixed cooling roll and a movable cooling roll through a nozzle located thereabove and rapidly solidified at the kissing region to form a metallic tape. In this case, pushing forces added to the movable cooling roll by hydraulic cylinders at driving and operational sides are controlled by adding to or subtracting from a standard pushing force an adjusting quantity of the pushing force as a function of a difference between a roll gap at the driving side and a roll gap at the operational side.

2 Claims, 8 Drawing Figures

PROCESS AND APPARATUS FOR THE PRODUCTION OF RAPIDLY SOLIDIFIED METALLIC TAPES BY DOUBLE-ROLL SYSTEM

This invention relates to a process and an apparatus for producing rapidly solidified metallic tapes by a double-roll system, and more particularly to a double-roll type process and apparatus for the production of rapidly solidified metallic tapes in which molten metal can be solidified at an appropriate position and uniformly in lengthwise direction of roll to produce a metallic tape having a relatively wide width.

As a process for pouring and rapidly cooling molten metal on a surface of a cooling roll to obtain an amorphous or crystalline metallic tape, there is a double-roll type process for the production of rapidly solidified metallic tapes. In order to practice this process, there is used an apparatus comprising a fixed cooling roll and a movable cooling roll capable of contacting with and leaving from the fixed cooling roll, wherein molten metal is poured in a roll kissing region defined between the rolls through a nozzle located above the roll kissing region and rapidly solidified at this kissing region.

In such a double-roll type process, three solidification forms as shown in FIGS. 1*a*–1*c* are caused at the kissing region. According to this process, molten metal 3 is continuously poured from above into the kissing region between a pair of cooling rolls 1, 2 rotating in arrow directions, so that it is rapidly solidified through the kissing region to form a metallic tape 4, which is then taken out beneath the kissing region.

In FIG. 1*a*, the solidification finish point of molten metal 3 locates above the kissing region, so that the resulting metallic tape 4 is subjected to hot deformation at the kissing region. In order to prevent the hot deformation, it is required to have a large pushing force and consequently the damage of each roll becomes conspicuous. The solidification form of FIG. 1*a* is called as a rolling-type solidification hereinafter.

In FIG. 1*b*, the solidification finish point of molten metal 3 locates in the kissing region, so that the metallic tape 4 is hardly subjected to hot deformation. Therefore, the metallic tape can be produced at a small pushing force and the damage of the roll is less. The solidification form of FIG. 1*b* is called as a kissing point solidification finish-type solidification hereinafter.

In FIG. 1*c*, the solidification finish point of molten metal 3 locates beneath the kissing region, so that the damage of the roll is less but unsolidified portion of molten metal is existent inside the metallic tape 4 to cause the break-out of the tape. The solidification form of FIG. 1*c* is called as an unsolidification-type solidification hereinafter.

Among the three solidification forms, the kissing point solidification finish-type solidification shown in FIG. 1*b* is most suitable, which is significant to be held over the whole area in the widthwise direction of the metallic tape.

Heretofore, screw or spring has been used as a pushing means for the movable cooling roll, so that a gap between the rolls was pre-set before the pouring of molten metal. As a result, it was very difficult to stably hold the solidification form of FIG. 1*b*.

On the contrary, the inventors have confirmed theoretically and experimentally that the solidification finish point of molten metal can stably be put close to the kissing region as shown in FIG. 1*b* by using a hydraulic cylinder 5 as shown in FIG. 2 to control pushing forces at the driving side and operational side of the movable cooling roll 2.

In FIG. 2 is shown a side view of an apparatus for the production of metallic tapes adopting such a hydraulic loading system, wherein a fixed cooling roll 1 set through a roll chock 7 and a movable cooling roll 2 set through a slidable chock 8 are arranged in a horizontal housing 6. Moreover, as shown in FIG. 4, two slidable chocks 8 are arranged at the driving and operational sides to the movable cooling roll 2, to each of which is given a pushing force by the respective hydraulic cylinder 5 (which is arranged to each of the slidable chocks). To a kissing region 9 defined between the rolls 1, 2 rotating in arrow directions X, Y is continuously supplied a flow of molten metal 12 through a nozzle 11 of a molten metal feeding means 10 arranged above the kissing region, which is rapidly solidified at the kissing region 9 and taken out beneath the kissing region as a metallic tape 4.

However, when the metallic tapes, particularly wide metallic tapes are produced by using double rolls of hydraulic pushing system as shown in FIG. 2, a difference in a roll gap between the rolls 1, 2 may be caused between the driving and operational sides as shown in FIG. 3. As a result, three solidification forms as shown in FIGS. 1*a*–1*c* are produced in accordance with the roll gap difference in the widthwise direction of the metallic tape 4, so that it is difficult to provide a uniform pushed state in the widthwise direction of the metallic tape.

The cause of producing the aforementioned disadvantage is considered to be based on the fact that heat crown is produced in the cooling roll to fluctuate a central pushing point, whereby the rotational moment of the cooling roll is unbalanced, the difference in the resistance of slidable chock is produced between the driving side and the operational side, and the molten metal distribution in the lengthwise direction of the cooling roll becomes ununiform.

The solidification forms in the widthwise direction of the metallic tape differ from each other at any sections of the solidified state shown in FIG. 3. That is, the section taken along a line A—A of FIG. 3 is a rolling-type solidification as shown in FIG. 1*a*, the section taken along a line B—B of FIG. 3 is a kissing point solidification finish-type solidification as shown in FIG. 1*b*, and the section taken along a line C—C of FIG. 3 is an unsolidification-type solidification as shown in FIG. 1*c*. In this solidified state of FIG. 3, the unsolidified portion is broken out just beneath the kissing region to leave only the complete solidification portion, so that only the metallic tape having a narrow width is obtained.

With the foregoings in mind, the invention is to provide a process and an apparatus for producing rapidly solidified metallic tapes by a double-roll system, which can maintain the solidification form of molten metal at an appropriate position and uniformly in the lengthwise direction of the roll, and can continuously produce metallic tapes having a wider width.

According to the invention, there are provided a process and an apparatus for producing rapidly solidified metallic tapes by a double-roll system wherein molten metal is poured into a kissing region defined between a fixed cooling roll and a movable cooling roll capable of contacting with and leaving from the fixed cooling roll through a nozzle located thereabove and rapidly solidified at the kissing region to form a metallic tape, characterized in that pushing forces exerting on the movable cooling roll are added by means of hydraulic cylinders arranged at driving and operational sides of this roll, respectively, and controlled by adding to or subtracting from a standard pushing force an adjusting quantity as a function of a difference between a roll gap at the driving side and a roll gap at the operational side.

The invention will now be described in detail with reference to the accompanying drawing, wherein:

FIGS. 1*a*–1*c* are longitudinal sectional views illustrating various solidification forms at a roll kissing region as previously mentioned, respectively;

Figure 4:
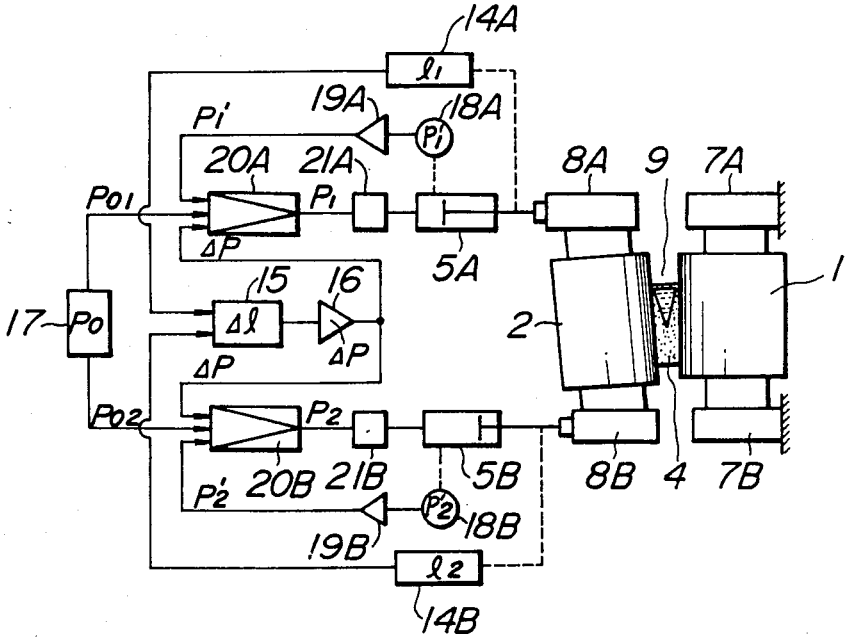
FIG. 4 is a block diagram of a control system in the apparatus for practicing the double-roll type process according to the invention.

As shown in FIG. 4, a movable cooling roll 2 is pushed to a fixed cooling roll 1 supported at driving and operational sides by roll chocks 7A and 7B and molten metal is rapidly solidified at a kissing region 9 defined between both rolls to produce a metallic tape 4. The movable cooling roll 2 is supported at the driving and operational sides by slidable chocks 8A and 8B so as to contact with and leave from the fixed cooling roll 1, each of which chocks is actuated by a respective hydraulic cylinder 5A or 5B.

In the movable cooling roll 2 are arranged a roll gap sensor 14A detecting a roll gap $l_1$ at the driving side of the roll 2 and a roll gap sensor 14B detecting a roll gap $l_2$ at the operational side of the roll 2, respectively. The output signals detected from these sensors are supplied to a comparator 15, whereby a difference in roll gap between the driving side and the operational side is obtained as $\Delta l = l_1 - l_2$.

The output signal from the comparator 15 is supplied to a converter 16, at where the conversion of roll gap into pushing force is calculated to measure an adjusting quantity of the pushing force ($\Delta P$). This calculation is fundamentally determined by $\Delta P = f(\Delta l)$, and simply by $\Delta P = B \cdot \Delta l$, where B is a coefficient for the conversion of roll gap into pushing force.

Figure 1A:
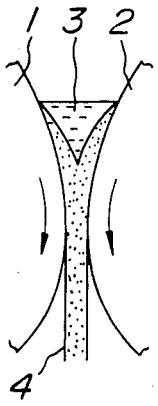
Figure 1B:
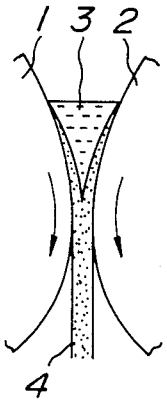
Figure 1C:
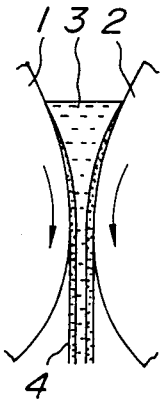

Reference numeral 17 is a setting unit for a standard pushing force $P_0$, which is required for maintaining the kissing point solidification finish-type solidification form as shown in FIG. 1*b* or an appropriate solidification form close thereto over a whole widthwise area of a metallic tape, from which are supplied output signals of standard pushing forces $P_{01}$ and $P_{02}$ at the driving and operational sides, respectively. In this case, the relationship among $P_0$, $P_{01}$ $P_{02}$ is represented by $P_0 = P_{01} + P_{02}$. Furthermore, the value of $P_0$ is calculated by the following equation as a function of resistances $F_1$ and $F_2$ of the slidable chocks at the driving and operational sides:

$$P_0 = A \cdot W + F_1 + F_2,$$

wherein W is a width of the metallic tape and A is a pushing force per unit width required for getting the solidification finish point at an appropriate position.

Moreover, the pushing force per unit width can be represented by $A = A(R,E,v,\sigma)$, wherein R is a radius of the roll, E is a Young's modulus of the roll material, v is a Poisson's ratio of the roll material and $\sigma$ is a deformation resistance of the metallic tape.

On the other hand, working pressures or pushing forces $P'_1$ and $P'_2$ of hydraulic cylinders 5A and 5B at the driving and operational sides are detected by means of hydraulic sensors 18A and 18B, respectively. The detected values of pushing forces $P'_1$ and $P'_2$ are amplified through amplifiers 19A and 19B and then supplied as feedback signals to computing units 20A and 20B, respectively.

To the computing unit 20A at the driving side are supplied signals of the standard pushing force $P_{01}$ and the adjusting quantity of pushing force $\Delta P$ in addition to the detected value of pushing force $P'_1$, at where a corrective pushing force $P_1$ is calculated as follows.

That is, when the roll gap at the driving side $l_1$ is larger than the roll gap at the operational side $l_2$, i.e. $l_1 - l_2 = \Delta l > 0$, the corrective pushing force $P_1$ is determined by the calculation of $P_1 = P_{01} + \Delta P$. In case of $\Delta l > 0$, the corrective pushing force $P_1$ is determined by the same calculation.

To the computing unit 20B at the operational side are supplied signals of the standard pushing force $P_{02}$ and the adjusting quantity of pushing force $\Delta P$ in addition to the detected value of pushing force $P'_2$, at where a corrective pushing force $P_2$ is calculated as follows.

That is, when the roll gap at the driving side $l_1$ is larger than the roll gap at the operational side $l_2$, i.e. $l_1 - l_2 = \Delta l > 0$, the corrective pushing force $P_2$ is determined by the calculation of $P_2 = P_{02} - \Delta P$. In case of $\Delta l > 0$, the corrrective pushing force $P_2$ is determined by the same calculation.

The output signals of corrective pushing forces $P_1$ and $P_2$ from the computing units 20A and 20B are supplied to respective servo valves 21A and 21B to actuate these valves, whereby the pushing forces of the hydraulic cylinders 5A and 5B at the driving and operational sides are controlled in accordance with the difference of roll gap $\Delta l$ so as to be $P'_1 \rightarrow P_1$ and $P'_2 \rightarrow P_2$. It is to be noted that the standard values of the pushing force ($P_{01} + P_{02}$) and the roll gap are previously determined in accordance with the kind of molten metal used, by trial and error method.

As mentioned above, according to the invention, even a wide metallic tape can continuously be produced at a stable state, while maintaining the solidification form of molten metal at an appropriate position and uniformly in the widthwise direction of the tape, only by setting the standard pushing force $P_0$ to a predetermined appropriate value.

The invention will now be described in detail with reference to the following example.

EXAMPLE 1

Figure 2:
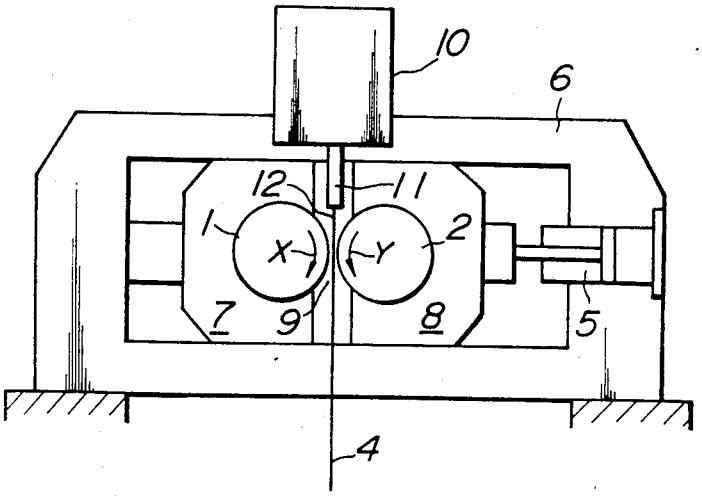
FIG. 2 is a side view of the double-roll type apparatus for the production of rapidly solidified metallic tapes adopting a hydraulic pushing system as previously mentioned.
Figure 3:
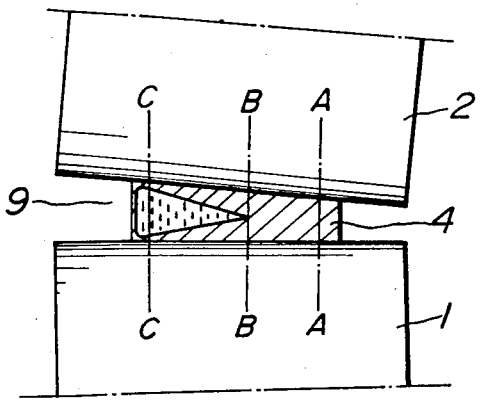
FIG. 3 is a transverse sectional view at the roll kissing region of FIG. 2 which illustrates a state of producing the difference of roll gap between the driving side and operational side as mentioned above.

In the apparatus of FIG. 2, metallic tapes were produced under production conditions of roll diameter of 400 mm, roll peripheral speed of 12 m/sec, tape material of 6.5% Si-Fe and tape width of 150 mm and control conditions of standard pushing force per unit width A of 13 kg/mm and coefficient for conversion of roll gap into pushing force B of 20 kg/μm (width: 150 mm). In this way, there was made comparative test of the invention (control of pushing force) with the prior art (no control of pushing force).

Figure 5:
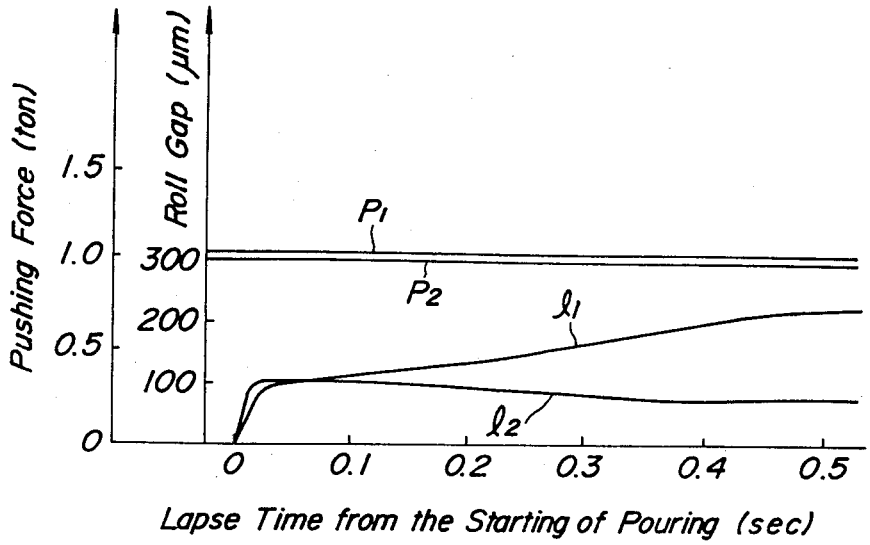
FIG. 5 is a graph showing changes of roll gaps at the driving and operational sides according to the prior art.
Figure 6:
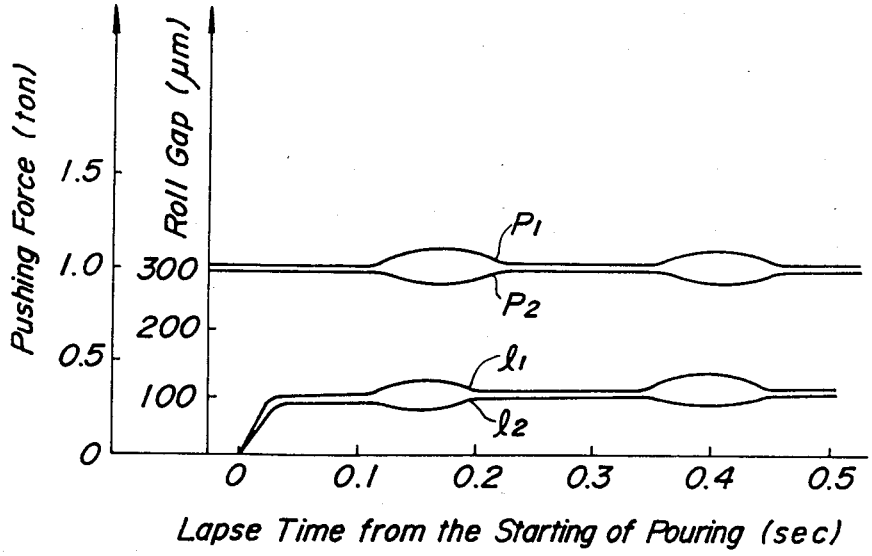
FIG. 6 is a graph showing changes of roll gaps at the driving and operational sides according to the invention.

FIG. 5 is a graph showing the test result of the prior art, while FIG. 6 is a graph showing the test result of the invention. In these graphs, an abscissa is a lapse time from the starting of the pouring (second), an ordinate is a pushing force (ton) and a roll gap (roll clearance, μm), a line $P_1$ is the pushing force at the driving side, a line $P_2$ is the pushing force at the operational side, a line $l_1$ is the roll gap at the driving side, and a line $l_2$ is the roll gap at the operational side.

As apparent from FIG. 5, according to the prior art, the roll gap difference was caused between the driving side and the operational side at an early stage after the starting of the pouring and gradually promoted with a lapse of time, so that the metallic tape having a given width of 150 mm was obtained only at an initial restricted time after the pouring.

As apparent from FIG. 6, according to the invention, the roll gap difference ($\Delta l = l_1 - l_2 = 20$ μm) was also caused in about 0.1 second after the starting of the pouring likewise the prior art, but the pushing forces at the driving and operational sides were corrected by applying the adjusting quantity of $\Delta P = 15.0$ kg to the hydraulic cylinders at the driving and operational sides to remove the roll gap difference in about 0.07 second, so that the solidification form of molten metal was maintained at an appropriate position and uniformly in the lengthwise direction of the roll and the metallic tape having a given width was produced continuously. Such an experimental result was simultaneously shown in FIG. 6. In the actual operation, however, a fast response speed for the correction of pushing force was obtained by making the coefficient for conversion of roll gap into pushing force large within a range causing no hunching.

As apparent from the above, according to the invention, rapidly solidified metallic tapes having a given width can continuously be produced by maintaining the solidification form of molten metal at the appropriate position and uniformly in the lengthwise direction of the roll in the double-roll system.

EXAMPLE 2

In the apparatus of FIG. 2, a melt of 304 steel was continuously poured under such conditions that a roll diameter is 550 mm, a roll peripheral speed is 3 m/sec, a standard pushing force is 10 kg/mm, a coefficient for conversion of roll gap into pushing force is 25 kg/μm and a width of a nozzle is 200 mm, whereby there was obtained a steel tape having a thickness of 300 μm and a width of 200 mm.

What is claimed is:

1. In a process for producing rapidly solidified metallic tapes by a double-roll system, which process includes pouring molten metal into a kissing region defined between a fixed cooling roll and a movable cooling roll capable of contacting with and leaving from the fixed cooling roll, through a nozzle located thereabove, said molten metal rapidly solidifying at the kissing region to form a metallic tape, the improvement which comprises adding pushing forces exerted on the movable cooling roll by arranging hydraulic cylinders at driving and operational sides of the movable cooling roll, respectively, and controlling the pushing forces by adding to or subtracting from a predetermined standard pushing force value, an adjusting quantity as a function of the difference between a roll gap at the driving side and a roll gap at the operational side of the movable cooling roll.

2. An apparatus for producing rapidly solidified metallic tapes by a double-roll system, the apparatus comprising a fixed cooling roll and a pair of roll chocks supporting the fixed cooling roll at driving and operational sides thereof, a movable cooling roll and a pair of slidable chocks supporting the movable cooling roll at driving and operational sides thereof so as to contact with and leave from the fixed cooling roll, said fixed and movable cooling rolls defining a kissing region therebetween, a pair of hydraulic cylinders, each of which actuating a respective one of said slidable chocks at the driving and operational sides of the movable cooling roll, respectively, molten metal feeding means comprising a nozzle disposed above said kissing region for pouring a molten metal thereinto so as to rapidly solidify and form a metallic tape, a setting unit for predetermined standard pushing force which supplies predetermined values of standard pushing forces $Po_1$ and $Po_2$ to the hydraulic cylinders at the driving and operational sides of the movable cooling roll sensing means for detecting pushing forces of the hydraulic cylinder and for detecting a roll gap at the driving side and at the operational side of said movable cooling roll, comparing means for receiving detected values of the pushing forces and the roll gap and comparing the same with said predetermined values of the pushing forces, and adjusting and controlling means for first calculating and determining adjusting quantities of the pushing forces and then calculating the corrective pushing forces and applying the corrective pushing forces to the hydraulic cylinders by controlling the pushing forces of the hydraulic cylinders at the driving and operational sides of said movable cooling wall in accordance with the difference of the roll gap.

* * * * *